US007316637B2

(12) United States Patent
German et al.

(10) Patent No.: US 7,316,637 B2
(45) Date of Patent: Jan. 8, 2008

(54) MECHANICAL DEVICE FOR PERFORMING SINGLE, ORTHOGONAL, ALTERNATE, AND INDEPENDENT MOVEMENTS APPLICABLE TO A GYM APPARATUS

(76) Inventors: Jaime Alberto German, Dr. Nicolas Repeto 1691, (1416) Buenos Aires (AR); Norberto Hugo Baldoni, Calle 50 N° 1683, (1900) La Plata Pcia de Bs As (AR); Natalio Hupert, Juan Agustin Garcia 2372, (1416) Buenos Aires (AR); Julio Cesar Bralo, Pte Paron, 1740, 6° F, (1037) Buenos Aires (AR)

( * ) Notice: Subject to any disclaimer, the term of this patent is extended or adjusted under 35 U.S.C. 154(b) by 400 days.

(21) Appl. No.: 10/957,313

(22) Filed: Oct. 4, 2004

(65) Prior Publication Data

US 2006/0073938 A1 Apr. 6, 2006

(51) Int. Cl.
*A63B 21/00* (2006.01)
*A63B 22/00* (2006.01)

(52) U.S. Cl. ..... 482/135; 482/136; 482/148; 482/117

(58) Field of Classification Search ..... 482/92, 482/114–117, 133–136, 148, 146, 147
See application file for complete search history.

(56) References Cited

U.S. PATENT DOCUMENTS 4,754,964 A * 7/1988 Michaels ..... 482/112
7,115,078 B1 * 10/2006 Kalember et al. ..... 482/117

* cited by examiner

*Primary Examiner*—Glenn E. Richman
(74) *Attorney, Agent, or Firm*—Egbert Law Offices

(57) ABSTRACT

A mechanical device that performs single, orthogonal, alternate, and independent movements which, adapted in an apparatus, can be applied to the prevention of lower limb thrombosis suffered by people who spend long hours in a sitting position. The device includes a solid cylinder shaped as a horizontal axis with a solid, centered, and jointly-moving sphere with grooves on its surface, along which runs a guiding bolt that guides the movement all along the grooves. The guiding bolt is joined to one of the arms of a fork-shaped piece. On the other arm of the fork, there is a ball-holding cavity with a spring to push a ball into a depression on the sphere surface opposite to the grooves. The guiding grooves engraved on the piece, which are read by the guiding bolt, are transferred to the pedals adhered to the gym apparatus.

1 Claim, 6 Drawing Sheets

MECHANICAL DEVICE FOR PERFORMING SINGLE, ORTHOGONAL, ALTERNATE, AND INDEPENDENT MOVEMENTS APPLICABLE TO A GYM APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a mechanical device that performs single, orthogonal, alternate, and independent movements, and to the gym apparatus containing it. The apparatus can be applied to the prevention of lower limb thrombosis affecting people who spend long hours in a sitting position.

BACKGROUND OF THE INVENTION

1. Object of the Invention

The pathology called Deep Vein Thrombosis—DVT—commonly known as "coach class syndrome"—consists in the formation of blood clots in the lower limbs. To avoid this problem, some transport companies are removing seats in order to give passengers more room to walk around inside the vehicle that is transporting them.

With the present invention it would be unnecessary to remove seats or modify the interior design of planes. The same would apply to trains and buses. Moreover, the incidence of this disease and the cost of flight insurance would be reduced, thus lowering the cost of plane tickets.

The quality of work would also be optimized in factories and production lines by allowing physical activity, improving the quality of life for workers, and avoiding the possibility of suffering deep vein thrombosis in the lower limbs. This is an invention that improves the quality of life and also prolongs it.

2. Prior Art

There are different solutions in the market to avoid Deep Vein Thrombosis—DVT—. Among these are, for example, different types of small vein pacemakers which are placed inside the socks and whose electrodes stimulate the veins with small shocks so that the blood may return to the heart in a normal way. Another type of apparatus may be the one used by Huntleigh, which consists in an inflated cushion—known as "airgym"—that allows passengers to move their legs on the seat itself by placing the cushion under their feet, thus allowing to move them throughout the trip. This device is very easy to use and consists in two compartments joined by a tube and a valve. The idea is to push the air from one compartment into the other, but the device does not meet specialists' recommendations.

A device called "sky-runner" has been presented at the Patent Office in Spain under registry number P200100211. The system is of a small size and has been designed to be placed in the lower back side of passenger airplane seats. This apparatus allows passengers to practice only one of the movements recommended to prevent DVT symptoms. The invention has two pedals where passengers place their feet and a device that offers resistance to forward movement. The device may be used in a fixed position to allow the passenger to rest or as a system to do exercises or therapeutic cycling gym by allowing the independent movement of both feet.

DVT mainly affects passengers on long trips, where the great difficulty in moving the feet increases the chances of blood clot formation in the legs, which may then move to the lungs or brain generating painful or highly dangerous conditions.

At present, in order to minimize the risks of deep vein thrombosis, airlines recommend that passengers should take a short walk every two hours or do simple exercises in the most spacious areas of the plane, such as crouching or contracting the leg muscles from time to time while they stay in their seats, since this facilitates deep vein circulation. They also suggest drinking small quantities of water at regular intervals with the aim of preventing dehydration. They even recommend taking some aspirin, as long as it is not contra-indicated for other reasons, since this drug has anticoagulant effects. However, these recommendations are not easy to follow due to security reasons.

Abundant bibliography on different research projects may be found in, for example, Kraaijenhagen R. A., Haverkamp D., Koopman M. M., Prandoni P., Piovella F., Buller H. R., "Travel and Risk of Venous Thrombosis", Lancet, Oct. 28, 2000; 356 (9240): 1492-3 [Kesteven P. L. "Traveller's Thrombosis", Thorax, August 2000; 55 Suppl 1:s32-6. Arfvidsson B., Eklof B., Kistner R. L., Masuda E. M., Sato D. T., "Risk Factors for Venous Thromboembolism Following Prolonged Air Travel. Coach Class Thrombosis", Hematol. Oncol. Clin. North. Am., April 2000; 14(2):391-400, ix [Rege K. P., Bevan D. H., Chitolie A., Shannon M. S., "Risk Factors and Thrombosis after Airline Flight", Thromb. Haemost., June 1999; 81(6):995-6. Ferrari E., Chevallier T., Chapelier A., Baudouy M., "Travel as a Risk Factor for Venous Thromboembolic Disease: a Case-Control Study", Chest, February 1999; 115(2):440-4.

Consequently, and taking into consideration that, according to DVT specialists, the only valid movements to prevent thrombosis and reduce the risk of clots are two movements, a lateral "adduction-abduction" movement of the ankle and a "bending and extending" movement of the foot with knee elevation, the gym apparatus of the present invention allows the user to perform only those movements recommended by specialists and solves the problem to a great extent, thus allowing the passenger to follow all medical advice without moving from the seat. Moreover, by the only contact of the legs in a fixed position on the device of the present invention, vein "collapse" due to compression in the backside of the knee is avoided.

BRIEF SUMMARY OF THE INVENTION

The present invention refers to an invention patent application of a mechanical device that performs single, orthogonal, alternate, and independent movements, applicable to the therapeutic gym apparatus containing it; said device may be transported, installed under the seat in passenger vehicles or work chairs and later extended to be used, or may be embedded in the floor.

When applied to a gym apparatus, the mechanical device of the present invention allows the user to exercise the legs two possible ways: 1) By a "bending-extending" longitudinal movement, commonly known as "tip and heel", and 2) By an "adduction-abduction" lateral movement of the ankle with pivoting around a vertical axis to both sides, right and left, similar to the movement of a car windshield wiper.

The present invention allows those movements only, so when performing one of the previously mentioned movements (for example, number 1) there is no possibility of performing the other movement (for example, number 2), nor performing the movements at random or in a disorganized way.

In case the user may wish to intentionally modify the change of movement, along each movement there is a middle point marked by a recording device provided with a ball with spring that falls into a small depression or concavity, so when pressing his/her foot onto the device, the user detects such middle point; if the person wishes to change the movement, all he/she has to do is stop at that middle point and change the movement as from there.

The single-movement mechanical device of the present invention consists in a crosspiece system that allows two orthogonal, alternate, and independent movements along some guiding grooves engraved in the piece, which are read by a mechanical system that is fixed to a foot support.

When used by a person sitting with his/her feet on the pedals, the gym apparatus containing said mechanism performs the movements recommended for the prevention of the coach class syndrome without having to take walks or do uncomfortable exercises in spacious places.

The only movements that can be made with the feet when placed on the pedal are those of "bending and extending", the so-called "tip and heel" movement, represented on the Y axis in a Cartesian system, or the "adduction-abduction" movement, which is performed by twisting the ankle from right to left, represented on the X axis in a Cartesian system.

The invention can also be applied to a computer by using a mouse activated by the feet instead of a pedal. In this case, it is connected to a system of movement sensors similar to the one used by a manual mouse; another possibility is to use a foot joystick as an interface device as a gradual function switch (ON-OFF) or a positioning switch (potentiometer, accelerator, etc.).

The present invention may also be connected to controllers that record and store the pedal movements made by the passengers on long trips while they are in their seats, such information being useful in case of lawsuits.

DETAILED DESCRIPTION OF THE INVENTION

Figure 1:
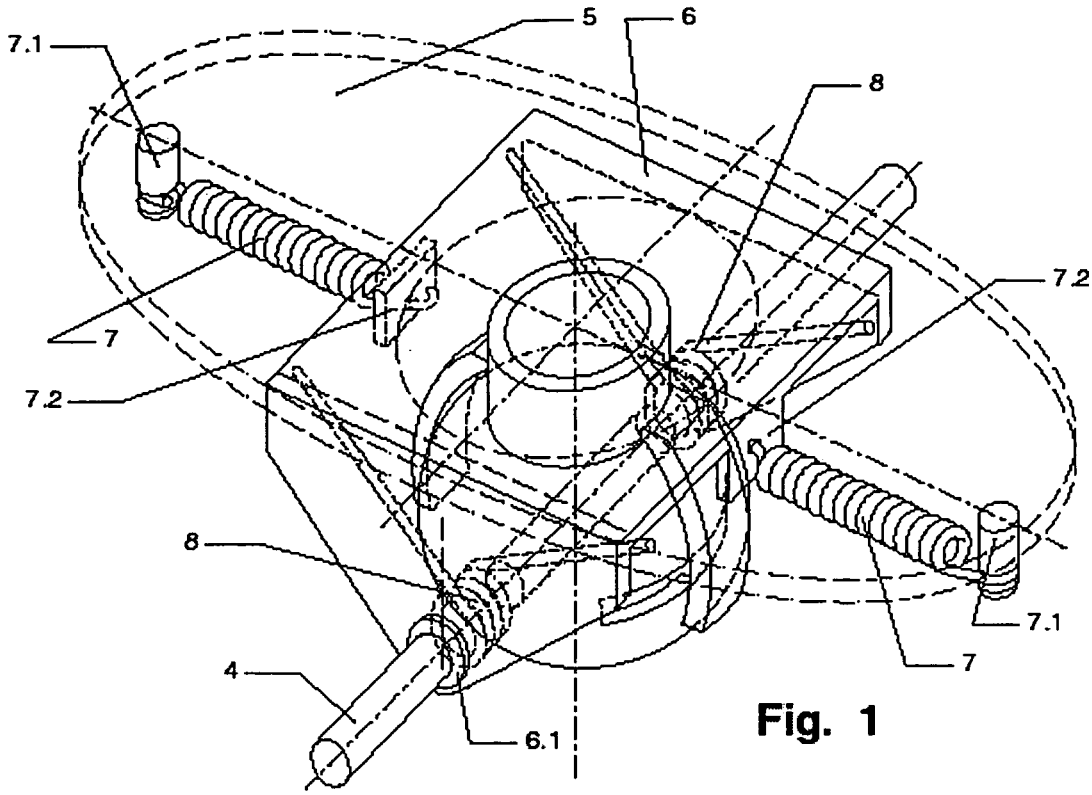
FIG. 1 is a transparent perspective view of the invention model and its basic parts.
Figure 2:
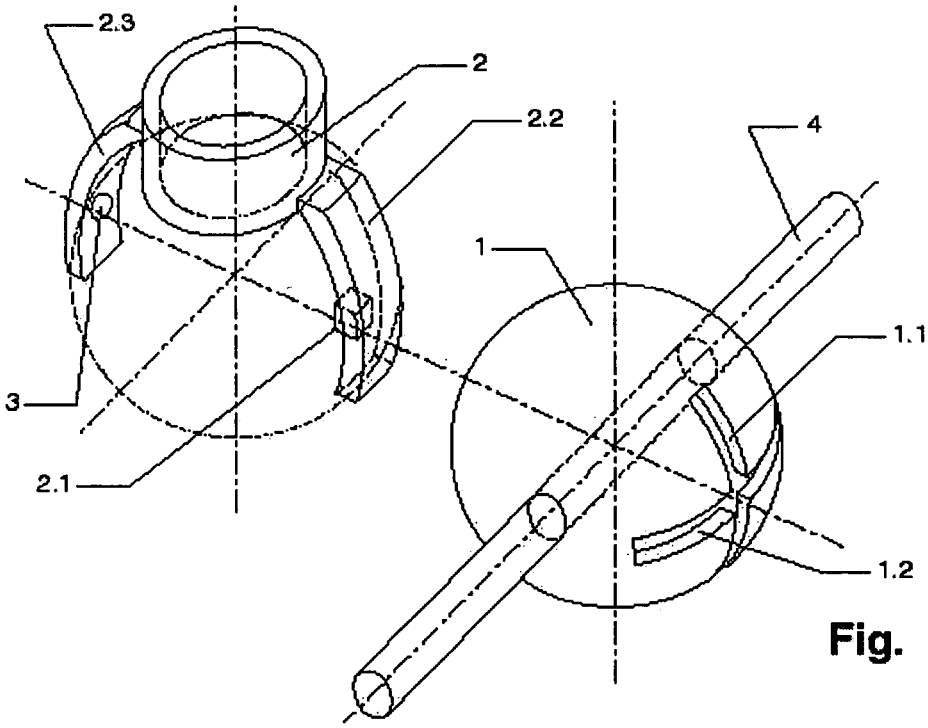
FIG. 2 is another transparent perspective view of the main parts.
Figure 3:
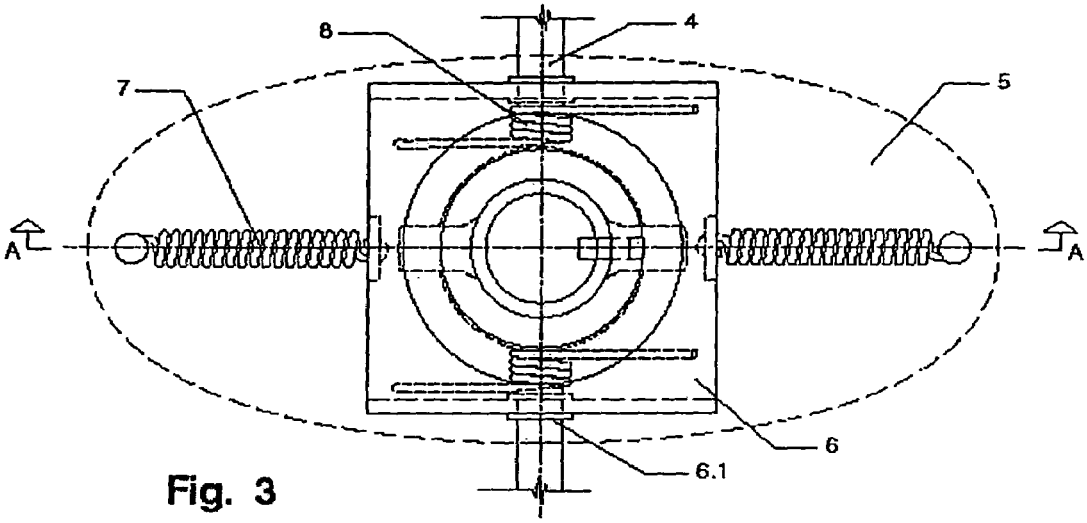
FIG. 3 is a top sectional view of the "pedal" assembly.
Figure 4:
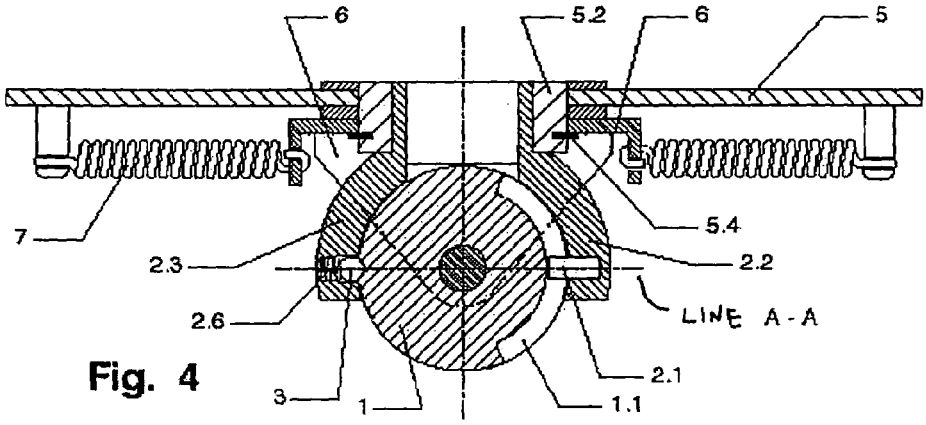
FIG. 4 is a longitudinal central cross-sectional view of the "pedal" assembly across line A-A.
Figure 5:
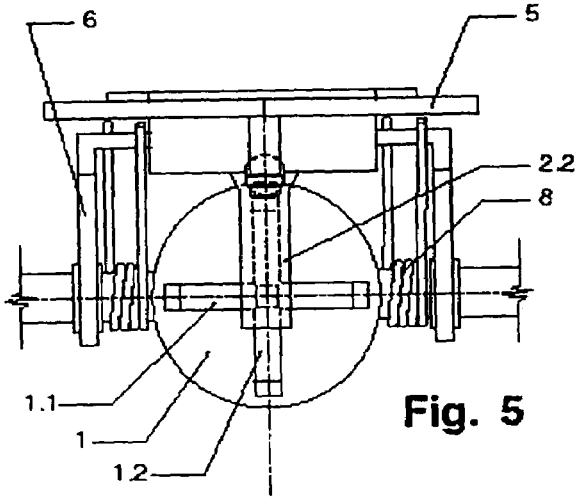
FIG. 5 is a front elevation view of the "pedal" assembly.
Figure 6:
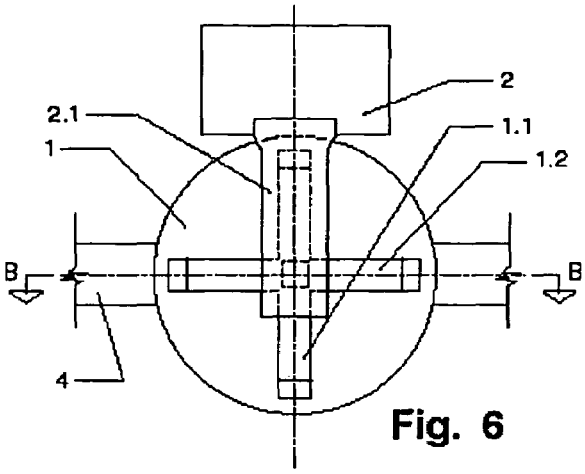
FIG. 6 is a front schematic view of the Main Sphere with its two grooves and stem.
Figure 7:
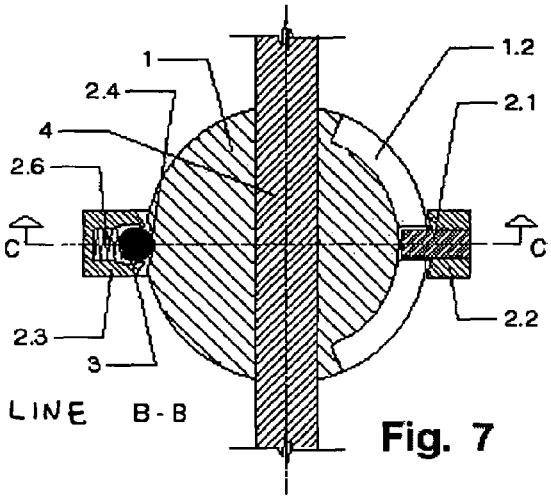
FIG. 7 is a B-B cross-sectional central view across line B-B.
Figure 8:
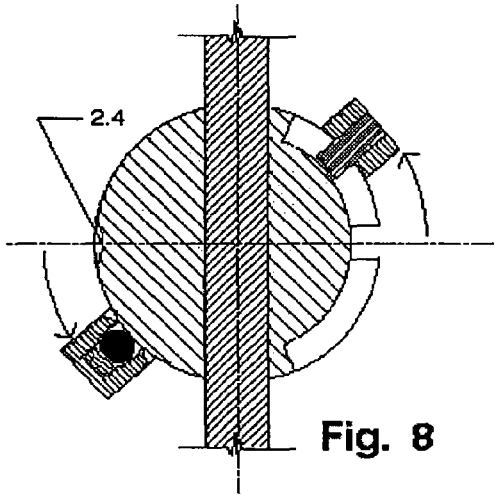
FIG. 8 is a B-B rotated longitudinal cross-sectional central view across line B-B.
Figure 9:
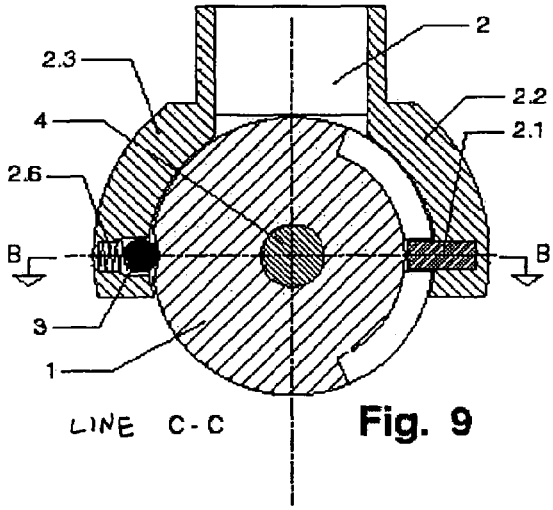
FIG. 9 is a C-C longitudinal cross-sectional central view across line C-C.
Figure 10:
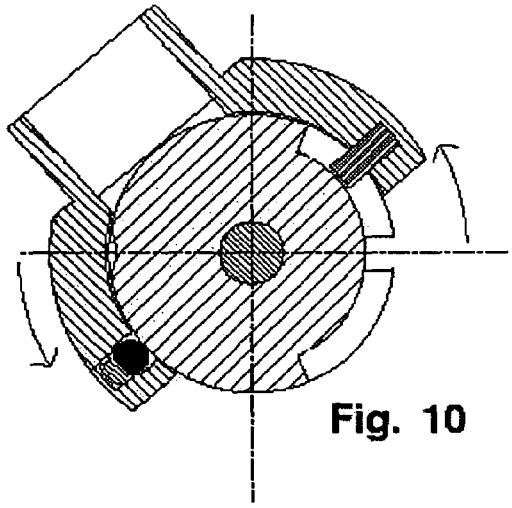
FIG. 10 is a C-C rotated longitudinal cross-sectional central view across line C-C.
Figure 11:
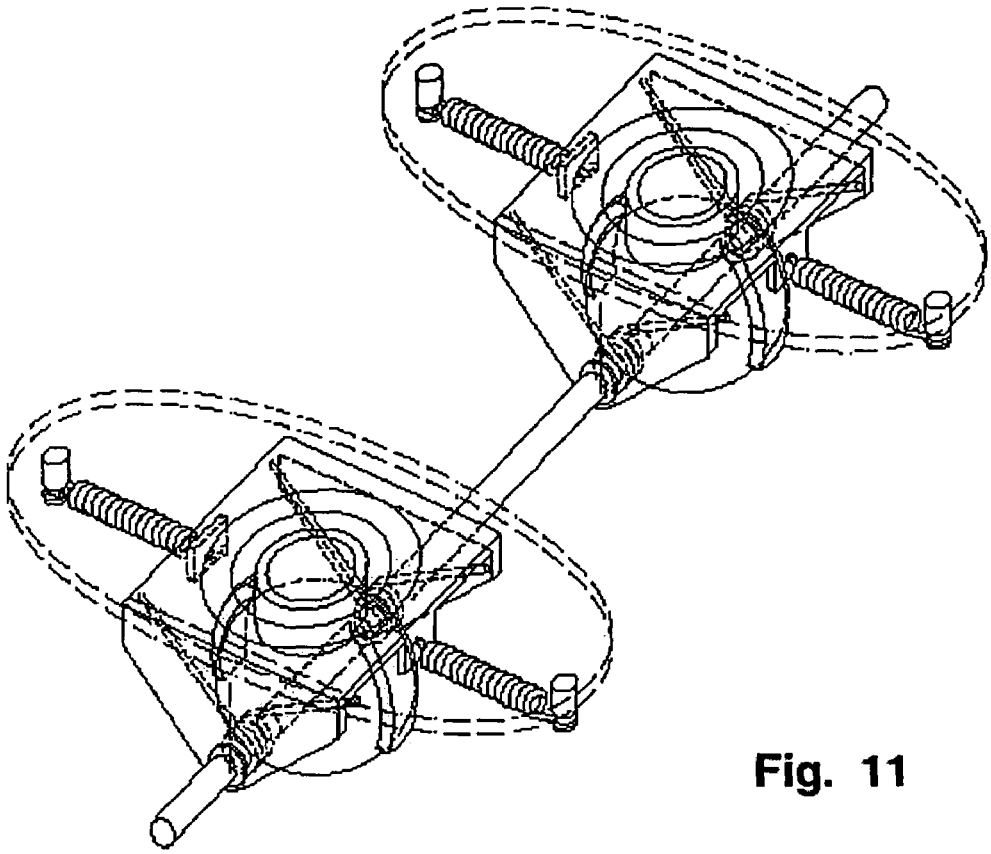
FIG. 11 is a transparent Perspective view of both feet assembly.
Figure 12:
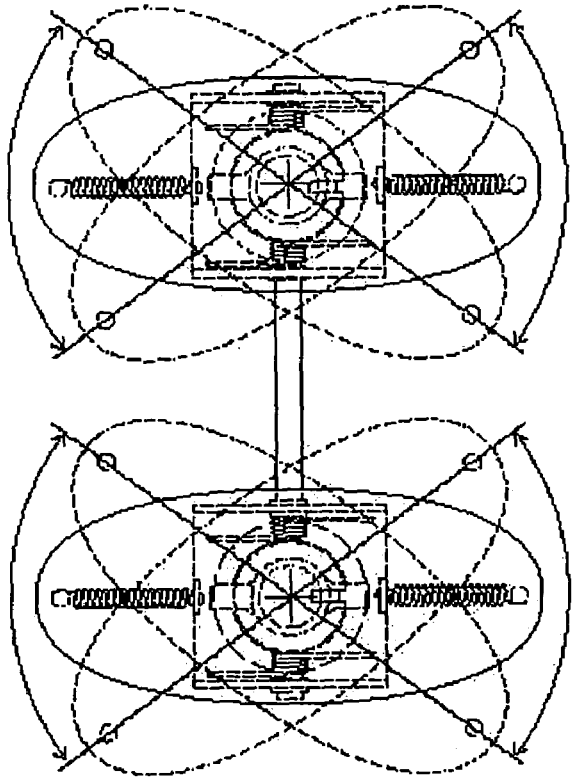
FIG. 12 is a top sectional view of the assembly with lateral movement.

The present invention consists in a solid cylinder shaped as a horizontal axis which will be called Central Sphere-Supporting Axis Bar (4), which has a solid centered and jointly-moving sphere that will be called (1), having two grooves or furrows on its surface forming a cross: the Vertical Groove (1.1) and the Horizontal Groove (1.2) (for ease of explanation, the center or origin of the Cartesian coordinates X, Y, and Z is set at the geometrical center of the sphere). These grooves are on the X and Y axes of said Cartesian system. Along the whole length of said grooves moves a Guiding Bolt (2.1). This Guiding Bolt is joined to an arm called Guiding Bolt Supporting Arm (2.2) and forms part of a Supporting Head Fork (2) that has another arm called Recording Ball Supporting Arm (2.3); the latter arm has a Recording Ball Cavity (2.5) that contains a Recording Ball Pushing Spring (2.6), that pushes a Recording Ball (3). This Ball falls into a depression on the sphere surface opposite to the grooves, called Hollow Circular Cavity (2.4), which is used for marking the neutral point. This is the point where the user can change between the two possible directions: the horizontal direction and the vertical direction, which make the cross on the sphere.

It should be noted that the jointly-moving assembly of the bar/sphere is fixed in the space with respect to the X, Y, and Z axes, so it has no movement whatsoever.

The invention is conceived in such a way that it may perform one of the movements (for example, the horizontal one) without its interfering with the other possible movement (the vertical one); the user can make each movement and, if he/she wishes to change the movement, he/she should stop at the neutral point marked by the cavity (2.4) and change the direction of the movement as from there. It is worth mentioning that each time the ball goes by the cavity, the user's foot perceives it and tends to stop there.

The solid cylindrical Bar (4) has a Supporting and Fixing Base to Axis Bar (6) that has a hole centered with respect to the Y axis, inside which the Foot Supporting Plate (5) and the Supporting Base (6) are connected to each other in a jointly-moving way. This allows the pedal/head assembly have a rotation movement around the Y axis. The Supporting Base (6) has two legs with holes through which runs the bar (4), and at that joining point it has a bolt in each leg called Plastic Bolt for Movement on Axis Bar (6.1). Between the sphere (1) and the Supporting Base legs (6) and located on the Bar (4) there is a space with a spring called Vertical Movement Spring (8), so there is a spring on each side of the sphere that offers resistance to the "bending-pulling" or vertical movement. On the support (6) is the Foot Supporting Plate (5) where the user places his/her foot, and it is linked to the support (6) by means of the Foot Support (5.1) and the Separation Arch for Lateral Movements (5.2), which makes the twisting movement of the plate (6) easy and gradual. These movements of twisting or "torsion" face the resistance of two longitudinal springs called Horizontal Movement Springs (7), which twist and have two anchorages, one to the Foot Supporting Plate (7.1) and the other anchorage to the Support Base (7.2). By means of their torsion and traction effort alone, resistance to the foot movements is provided. Thus, they provide resistance to the rotation around the Y axis and, at the same time, they exercise a balance force that tends to keep the system in the 0, 0, 0 position of the Cartesian system.

In case of using a mouse or joystick, the sensor system should be placed on the surface of the sphere grooves and the guiding bolt.

The gym apparatus of the present invention may be mounted under the seats of means of transport or in work chairs, or they may be embedded in the floor; they can also be manually transported inside a box.

Figure 13:
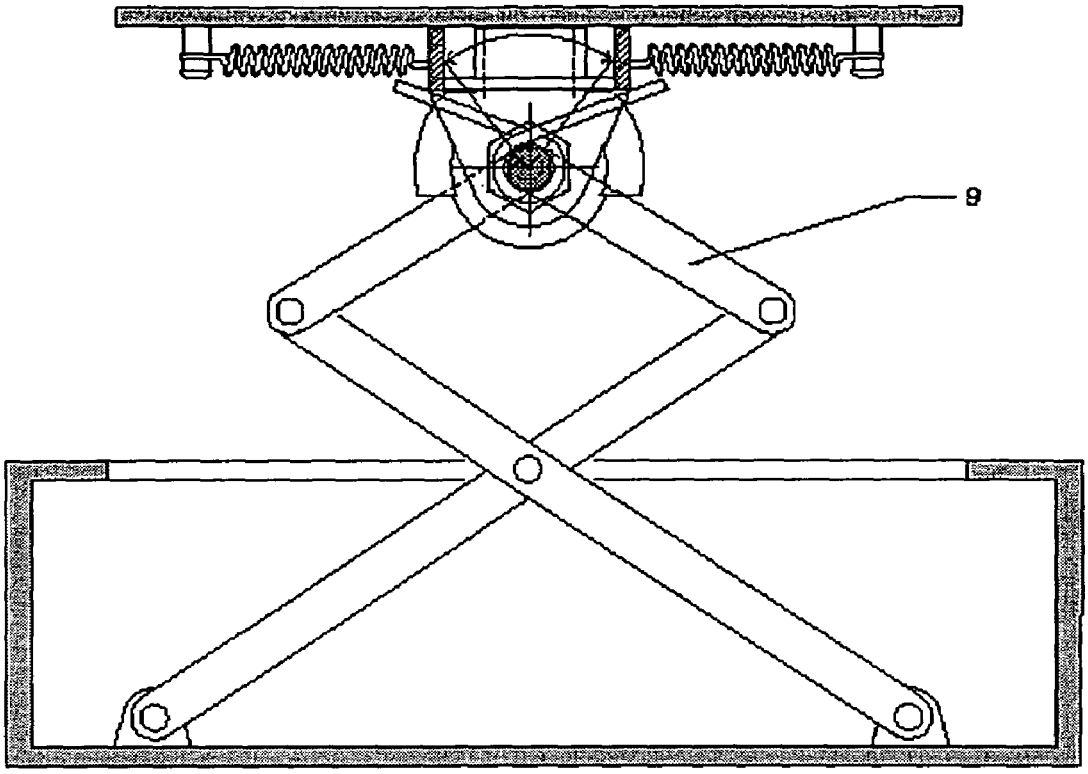
FIG. 13 is a side view of Application Example No. 1 of the model in an extended position.
Figure 14:
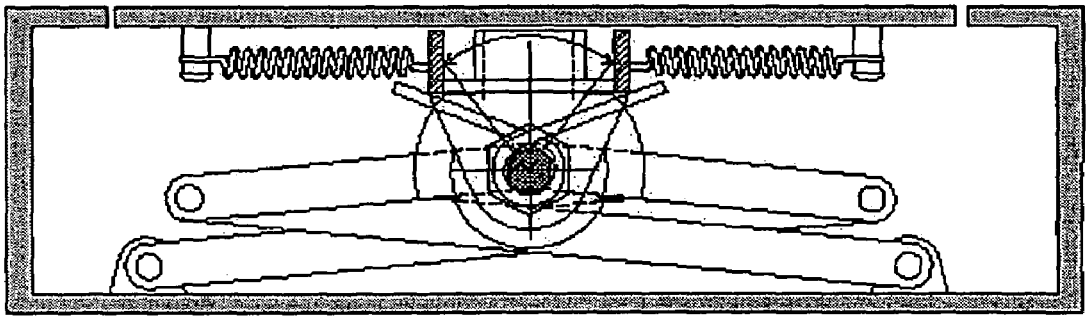
FIG. 14 is a side view of Application Example No. 1 of the model in a folded position.
Figure 15:
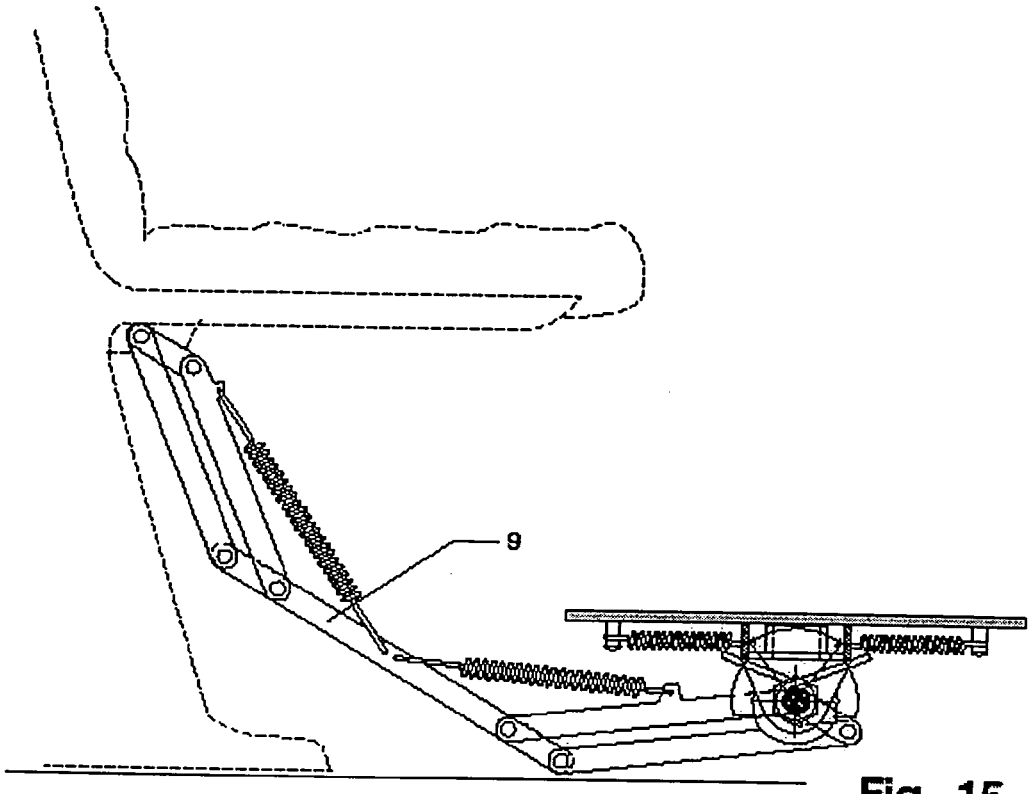
FIG. 15 is a side view of Application Example No. 2 of the model in an extended position.
Figure 16:
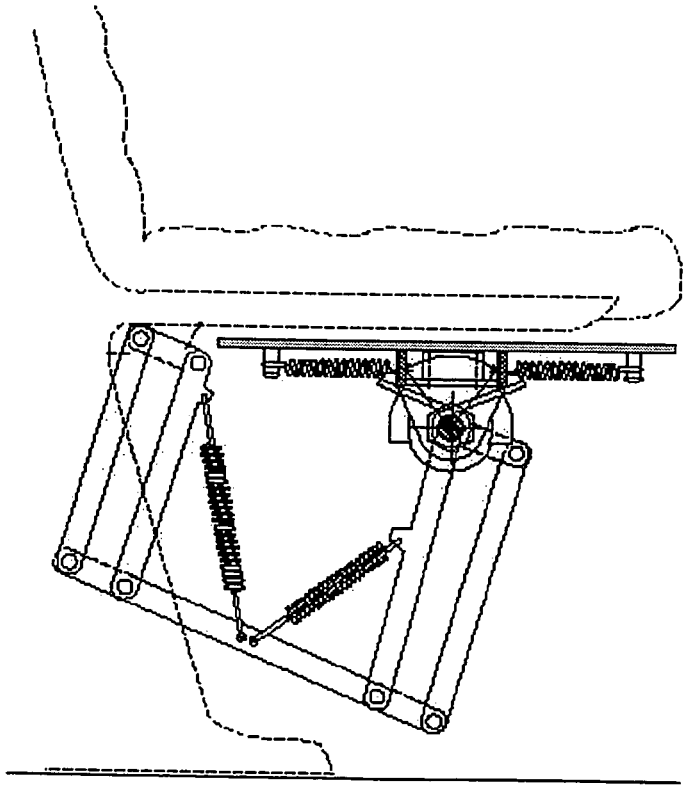
FIG. 16 is a side view of Application Example No. 2 of the model in a folded position.

In case it is transported inside a box or embedded in the floor, it should be provided with a closing scissors system; another possibility is to provide it with a telescopic extension system fixed under the seat, or a system that can be folded, as shown in detail in the figures of application example No. 1 (FIGS. 13 and 14). This is a folding model that may be portable or may be embedded in the floor of any vehicle adapted for such purpose, so as to then take it out and pull it up to the required height in order to be used. Also, in example No. 2 (FIGS. 15 and 16), there is a folding model that can be kept under a seat adapted for such purpose and taken out to be used at its appropriate height.

We claim:

1. A gym apparatus for performing single, alternate, orthogonal and independent movements, the apparatus comprising:

a solid sphere having grooves formed on a surface thereof;

a support base being interconnected to a guide bolt, said guide bolt received in one of said grooves and movable along the grooves;

a solid cylinder having a horizontal axis solidly centered in said sphere;

a fork-shaped piece having a pair of arms extending over said surface of said sphere, said guide bolt affixed to one of said pair of arm, the other of said pair of arms having a cavity formed therein, said cavity having a spring mounted therein;

a ball positioned against said spring in said cavity so as to be urged against said surface of said sphere, said sphere having a depression formed in said surface thereof opposite said grooves, said ball receivable in said depression when said fork-shaped piece is in a first position, said support base having a pair of legs extending downwardly therefrom, each of said pair of legs having a hole formed therein, said cylinder extending through the holes of said pair of legs; and a foot-supporting plate pivotally mounted on a cylindrical member extending upwardly from said support base, said foot-supporting plate having a pair of anchorages extending downwardly at opposite end thereof, said support base having a separating ring thereover, one of said pair of anchorages connected by a first spring to said separating ring, the other of said pair of anchorages connected by a second spring to said separation ring.

* * * * *